US005120186A

United States Patent [19]

Jorgenson

[11] Patent Number: 5,120,186

[45] Date of Patent: Jun. 9, 1992

[54] CRANE ATTACHMENT FOR LOADING MACHINES

[76] Inventor: Parnell L. Jorgenson, 112 N. 2nd St., Sierra Vista, Ariz. 85635

[21] Appl. No.: 732,095

[22] Filed: Jul. 18, 1991

[51] Int. Cl.[5] ..... B66C 23/06

[52] U.S. Cl. ..... 414/686; 414/687; 212/181; 212/189

[58] Field of Search ..... 414/686, 687, 920; 212/179, 180, 181, 189, 245, 254

[56] References Cited

U.S. PATENT DOCUMENTS

| | | | |
|---|---|---|---|
| 2,301,808 | 11/1942 | Mosher | 37/144 |
| 2,719,730 | 10/1955 | Beck | 280/150 |
| 2,770,895 | 11/1956 | Rymkevitch | 37/117.5 |
| 3,030,713 | 4/1962 | Hendrickson et al. | 17/117.5 |
| 3,042,236 | 7/1962 | Pilch | 414/687 X |
| 3,123,222 | 3/1964 | Livingston et al. | 212/189 X |
| 3,812,979 | 5/1974 | Leihgeber | 212/35 |
| 3,977,547 | 8/1976 | Holopainen | 414/687 |
| 4,200,423 | 5/1980 | Sornsin | 414/724 |
| 4,293,269 | 10/1981 | Zook | 414/686 |
| 4,406,574 | 9/1983 | Riley | 212/180 X |
| 4,509,768 | 4/1985 | Haung | 414/686 X |
| 4,523,684 | 6/1985 | Baisden | 212/175 |
| 4,960,359 | 10/1990 | Lovitt, Jr. | 414/686 |

OTHER PUBLICATIONS

0392672, European Patent Application, Oct. 17, 1990, Inventor Vlaanderen.

*Primary Examiner*—Robert J. Spar
*Assistant Examiner*—Donald W. Underwood
*Attorney, Agent, or Firm*—Antonio R. Durando; Harry M. Weiss

[57] ABSTRACT

A self-contained, full-function, crane attachment for loading machines that is capable of quick release coupling with the standard bucket attachment mechanism of conventional loaders. The attachment comprises a wheel-mounted supporting frame equipped with two hydraulically driven outriggers to provide additional stability and with a control panel pivotally adjustable for comfortable use from the loader's driver seat. A horizontal boom platform is rotatably connected to the supporting frame through a vertical central axle and a generally horizontal hydraulic cylinder for adjusting the relative position of the two, so as to provide a lateral rotational degree of freedom for the platform of approximately 45 degrees in either direction. The bottom of a boom is pivotally hinged to the back edge of the boom platform on one side of the axle, while a second hydraulic cylinder is similarly pivotally hinged on the opposite, front side and is also connected to the upper portion of the boom, so as to provide by its contraction and expansion a lifting action that determines the boom's position and elevation. The boom includes multiple stages that can be telescopically extended and retracted by a hydraulically driven boom cable system. A pulley at the tip of the boom and a winch-operated hoist cable with a hook provide the structure for securing and lifting heavy objects toward the tip of the extended boom. Finally, a system of hydraulic hoses and control valves, powered by the loader's hydraulic circuit, provides the control system for operating the crane attachment.

16 Claims, 5 Drawing Sheets

CRANE ATTACHMENT FOR LOADING MACHINES

BACKGROUND OF THE INVENTION

1. Field of the Invention

This invention pertains to the general field of construction and excavating equipment attachments intended to enable a user to perform other functions than those for which the equipment is designed. In particular, it provides a new and improved crane attachment that quickly converts a conventional loading machine, such as a skid steer loader, a backhoe, or a front-end loader, into a crane useable for lifting and moving objects within the perimeter of a work site.

2. Description of the Prior Art

People have been using cranes and hoisting devices to lift and move heavy objects for centuries. During the last few decades, though, movable motorized equipment has become indispensable for the efficient and competitive performance of construction and similar work. Accordingly, machinery such as front-end loaders, fork lifts, backhoes and the like have become common place at work sites.

Since this kind of equipment is expensive, manufacturers have from time to time designed accessory attachments that enable the same piece of equipment to be used for more than one function, so as to optimize the use of each machine. For example, attachments are available to transform front-end loaders into fork lifts by removing the standard bucket from its quick-release coupling mechanism and substituting it with a similarly coupled fork attachment. Other common attachments include lifting booms for tractors, graders and bulldozers. Typically, the standard coupling mechanism existing on the equipment is used to ensure the quick and safe engagement and disengagement of the accessory attachment as well.

Various boom attachments have been developed for use in conjunction with front-end loaders and backhoes to provide the function of a crane, normally in the form of a boom that is secured to the working arm or arms of the equipment and a cable with a hook for grabbing and lifting an object. Depending on the configuration of the equipment and the corresponding attachment, a winch with a pulley or sheave at the tip of the boom may also be provided.

For example, as early as 1942, in U.S. Pat. No. 2,301,808 Mosner describes a grader with a boom mounted on its blade frame and extending forward for use as a hoist. A guy cable is provided for adjusting the position of the boom, while a separate hoist cable is used for lifting objects secured to a hook. The boom portion of the grader is not intended to be a separate attachment; rather, it is an integral part of the machine, designed for lifting large objects that cannot be pushed out of the way by the forward motion of the blade of the grader.

U.S. Pat. No. 2,719,730 to Beck (1955) discloses a hydraulic hoist in the form of an attachment for tractors. The hoist is specifically constructed to fit on the back of a tractor for exerting a lifting force directly upwards, such as would be required for tilting a wagon being pulled by the tractor, lifting heavy weights, or pulling fence posts out of the ground. It consists of a hydraulic cylinder and a cable/hook combination. The lift is provided by the vertical expansion of the cylinder.

U.S. Pat. No. 2,770,895 to Rymkevitch (1956) shows a piece of equipment similar to the grader/hoist combination of Mosher, but provided in the form of a quick release attachment. A boom is connected to the frame of the bulldozer and is operated by the hydraulic power normally used to run the blade. No new power connection is required to run the boom, which is used to lift objects attached to its outer end by raising the blade structure that supports it.

In U.S. Pat. No. 3,030,713 (1962), Hendrickson et al. illustrate a material handling machine that features a boom extension for vertical drilling. The equipment is relevant for its use of a boom structure that could be adapted for lifting, but the design is specific for roof bolting in an underground mine environment.

U.S. Pat. No. 3,812,979 to Leihgeber (1974) discloses a lift boom for a front-end loader. The boom is attached to the loader by securing it to the bucket through a system of cables. By lifting and tilting the bucket through the normal power train used during its operation as a loader, the tip of the boom is raised, thereby causing any load attached to it to be lifted.

U.S. Pat. No. 4,200,423 to Sornsin (1980) describes a simpler boom attachment for the bucket of a front-end loader. A relatively light-weight telescopic boom is provided for direct connection to the top of the bucket, so that its motion can be controlled by the operation of the bucket itself. Again, loads are lifted by securing them to the tip of the boom and by tilting the bucket upwards, which causes the rising of the boom and of the load attached to it.

U.S. Pat. No. 4,293,269 to Zook (1981) shows an extension beam for an excavator. It is designed to replace the scoop bucket of the excavator to convert it from a power shovel to a power hoist. By utilizing the same hydraulic power train used to maneuver the scoop, the extension beam can be controlled to adjust its position for operating as a crane. The lifting function is provided by a standard winch/cable combination mounted on the beam attachment.

In U.S. Pat. No. 4,523,684 (1985), Baisden illustrates another crane attachment for replacing the bucket of an excavator arm. A sleeve is mounted on the arm and connected to the hydraulic power train of the backhoe for controlling an extendable boom contained in the sleeve, thus converting the machine into a crane. The boom in turn is fitted with a winch for lifting loads hooked to a cable through a pulley mounted on the outer end of the boom. The reach of the crane can be varied by extending or contracting the telescopically constructed boom.

Finally, U.S. Pat. No. 4,960,359 to Lovitt, Jr. (1990) describes a boom hoist for connection with the standard attachment points of the bucket of a front-end loader. The lifting motion is achieved by the tilt of the boom as the power train normally used to tilt the bucket is utilized to swing the boom upward. Because of the direct coupling of the device to the bucket attachments, it exhibits great maneuverability and control. However, it does not include the cable lifting action that is typical of a crane.

The main objective in the operation of a crane is the ability of the operator to lift and move a load maintaining the center of gravity of the loaded equipment within the area defined by the equipment's points of contact with the ground, normally determined by the two outer wheel axles or, if available, by extended outrigger pads. Secondly, it is important that the crane be easily maneuverable in order to permit the user to reach the object to be lifted and move it to the desired location, which at times may have to be accomplished in tight quarters with no open access. Thus, the usefulness of a crane is measured by its loading power, its reach, and its flexibility in handling material, all of which require mechanical sophistication, which in turn contributes to the high cost of cranes in general. It is because of the great expense associated with even small cranes that accessory attachments for other common types of equipment are developed.

All of the attachments described in the above referenced prior art constitute extensions of the working arms of the equipment to which they are attached; therefore, to the extent that the lifting boom is outside the perimeter of the outer wheels, they dangerously shift the center of gravity toward an unstable condition. As a result, the load that they are capable of lifting is often limited by the stability of the assembly, rather than by the power of the equipment. These attachments normally utilize the working motion of the various equipment components and are therefore limited by the power available to them. In addition, the maneuverability of the attachment becomes integrally related to and dependent upon the maneuverability of the equipment itself, because it becomes a part thereof, thus often inherently lacking the freedom of motion required for the efficient and safe use of a crane.

Therefore, there still exists a need for a new and improved, self-contained, crane structure for quick attachment to the coupling mechanism of a conventional loading machine and designed to minimize these problems. It is to the achievement of these goals that this invention is addressed.

BRIEF SUMMARY OF THE INVENTION

One objective of this invention is the maximization of the working stability of the loader when coupled to the crane attachment and used to lift and move heavy objects. This is achieved by providing the crane attachment with two hydraulically driven outriggers that extend forward and enlarge the supporting base of the assembly.

Another purpose of this invention is the ability to move the equipment in relatively small quarters to best position the crane attachment for lifting heavy weights. This is accomplished by mounting the attachment on wheels capable of following the normal motion of the loading machine.

Another objective of the invention is the attainment of great lifting power without regard to the loading capacity of the equipment. This is obtained by fitting the crane attachment with an independent winch/cable system that is self-contained and unrelated to the operation of the loading mechanism.

A further goal of the invention is the ability to reach and load weights at a distance outside the support base of the assembly. For that purpose, the boom of the crane attachment consists of multiple stages capable of telescopic expansion and contraction.

Yet another objective of this invention is the realization of the above mentioned goals in an economical and commercially viable manner. This is done by utilizing simple components that are either already available in the open market or can be produced at competitive prices.

According to these and other objectives, this invention consists of a self-contained, full-function, crane attachment for loading machines capable of quick release coupling with the standard bucket attachment mechanism of conventional loaders. The attachment comprises a wheel-mounted supporting frame equipped with two hydraulically driven outriggers to provide additional stability and with a control panel pivotally adjustable for comfortable use from the loader's driver seat. A horizontal boom platform is rotatably connected to the supporting frame through a vertical central axle and a generally horizontal hydraulic cylinder for adjusting the relative position of the two, so as to provide a lateral rotational degree of freedom for the platform of approximately 45 degrees in either direction. The bottom of a boom is pivotally hinged to the back edge of the boom platform on one side of the axle, while a second hydraulic cylinder is similarly pivotally hinged on the opposite, front side and is also connected to the upper portion of the boom, so as to provide by its contraction and expansion a lifting action that determines the boom's angle and elevation. The boom includes multiple stages that can be telescopically extended and retracted by a hydraulically driven boom cable system. A pulley at the tip of the boom and a winch-operated hoist cable with a hook provide the means for securing and lifting heavy objects toward the tip of the boom. Finally, a system of hydraulic hoses and control valves, powered by the loader's auxiliary hydraulic circuit, provides the control system for operating the crane attachment.

Various other purposes and advantages of this invention will become clear from its description in the specification that follow, and from the novel features particularly pointed out in the appended claims. Therefore, to the accomplishment of the objectives described above, this invention consists of the features hereinafter illustrated in the drawings, fully described in the detailed description of the preferred embodiment and particularly pointed out in the claims. However, such drawings and description disclose but one of the various ways in which the invention may be practiced.

DETAILED DESCRIPTION OF THE INVENTION

The heart of this invention lies in the novel working relationship and in the specific configuration of the various components constituting, in combination, the functional structure of this crane attachment. For the purpose of clarity, the invention is described in terms of separate components, according to what is believed to be a logical progression in structure and function.

Figure 2:
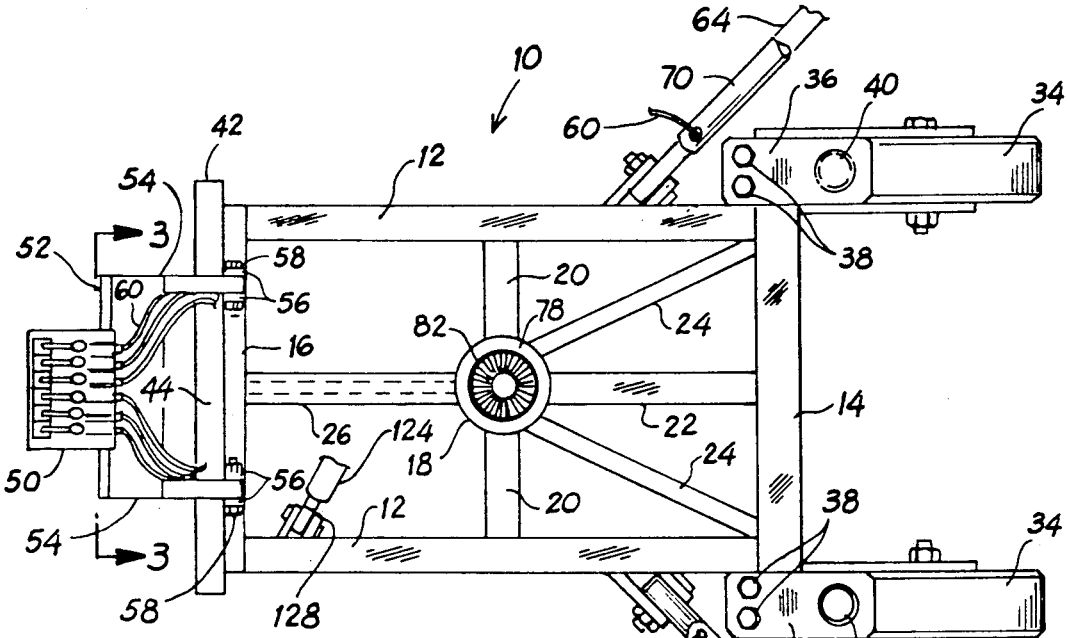
FIG. 2 illustrates a plan view of the same embodiment of the support frame of the invention in a rest position.
Figure 1:
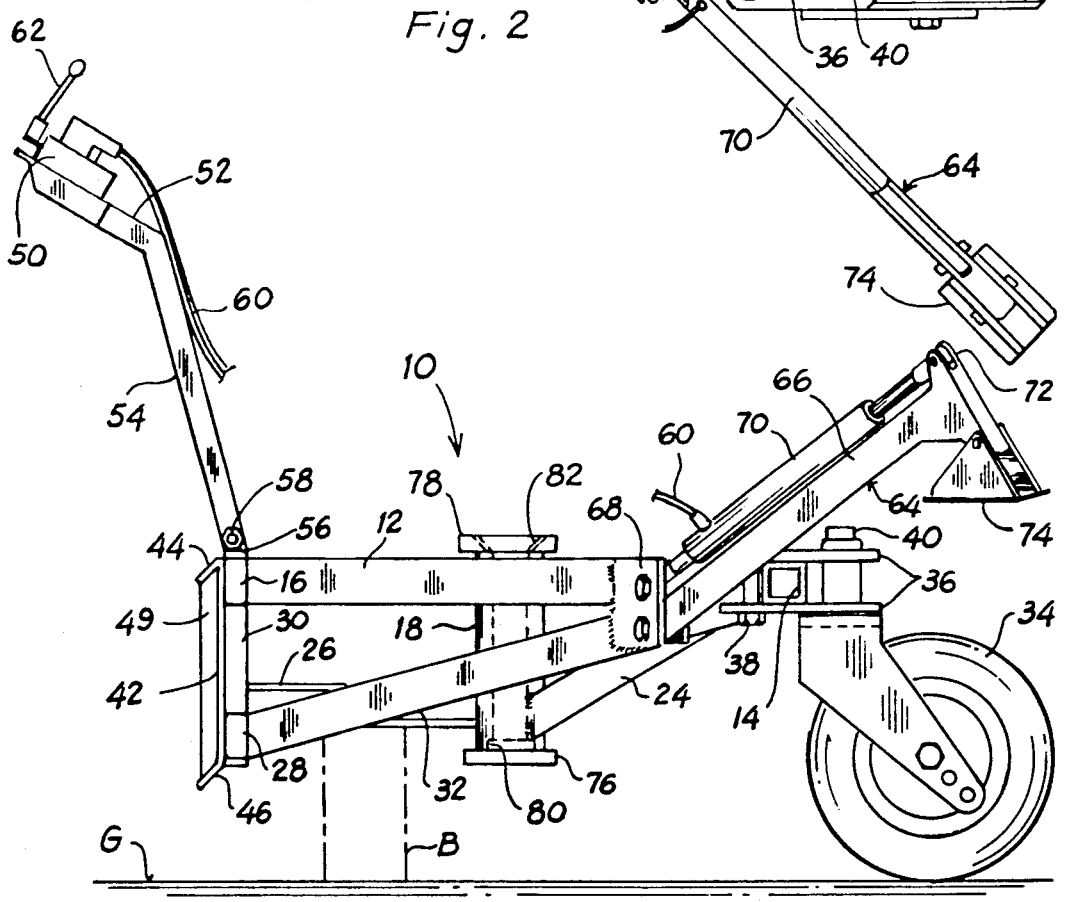
FIG. 1 illustrates a elevational side view of the wheel-mounted support frame of the crane attachment of this invention, shown in isolation before assembly with the other components constituting the invention, and a phantom line view of a support block used to keep it level while resting on the ground.
Figure 3:
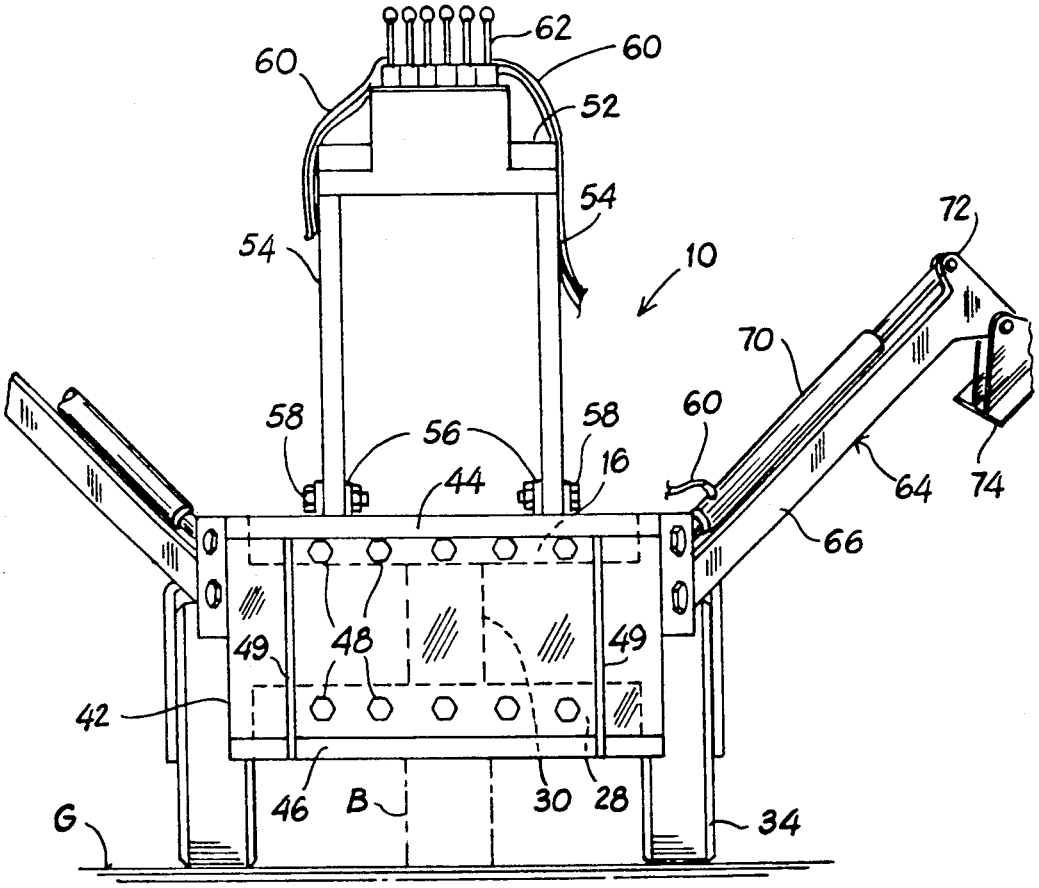
FIG. 3 illustrates a rear view of the same support frame taken along line 3—3 in FIG. 2.

Referring to the drawings, wherein like parts are designated throughout with like numerals and symbols, FIG. 1 illustrates a side elevational view of the crane attachment's support frame 10, shown in isolation, as it would appear resting on the ground G before assembly with the other components of the invention. A support block B (not part of the invention), holding the frame in a generally horizontal position, is shown in phantom line for a realistic representation. FIG. 2 illustrates a plan view of the same embodiment of the support frame of the invention and FIG. 3 shows a rear view taken along line 3—3 in FIG. 2. The frame 10 consists of a rigid structure formed by welding or otherwise attaching together metal beams or similar supporting members, such as channel iron or tubular components. A generally rectangular structure, consisting of two side beams 12, a front beam 14 and an upper rear beam 16, provides a base for the construction of the support frame 10. Approximately at the center of the rectangular structure so formed by beams 12, 14 and 16, the upper portion of a cylindrical sleeve 18 is rigidly connected to the structure by means of two horizontal trusses 20, positioned transversely, and one horizontal truss 22, positioned longitudinally with respect to the rectangular structure. The sleeve 18 is affixed vertically, so as to be capable of receiving and rotatably cooperate with an axle inserted therewithin. The bottom portion of the sleeve is further secured by two diagonal and slanted trusses 24, connecting it to the front beam 14, and by a lower horizontal beam 26 (shown as an I-beam in the figures), which is in turn connected to a lower rear beam 28 parallel to the upper rear beam 16. A vertical truss 30 rigidly connects beams 16 and 28, thus completing a strong and rigid structure for supporting a heavy boom platform anchored to the sleeve 18 through an axle (not shown in FIGS. 1-3) vertically mounted for rotation on a horizontal plane. Finally, two reinforcing braces 32 (one on each side of the support frame) connect the underside of the front of beams 12 with the ends of the lower rear beam 28. Thus, the resulting assembly constitutes a frame capable of providing the support required for a heavy crane structure.

The support frame 10 is equipped with large caster wheels 34 mounted on each end of the front beam 14 by means, for example, of clamps 36 and bolts 38, in a way that would be obvious to one skilled in the art. Standard swivel frames 40 provide the mobility characteristic of all caster wheels, so that the support frame 10 (and the crane structure carried by it) can be moved around by pulling and pushing on the rear end of the frame. The wheels are large enough to give a smooth ride on irregular terrain and to permit the frame to comfortably clear the ground when held in a generally horizontal position. Although not essential to the invention, rubber tires further contribute to the maneuverability and smooth operation of the equipment.

The rear portion of the support frame 10 is equipped with a quick-release coupling mechanism for attachment to the loader with which it is intended to be used. This mechanism is illustrated in this embodiment of the invention in the form of a plate 42, removably attached to the upper and lower rear beams 16 and 28 through a multiplicity of bolts 48, corresponding to the same general design used to attach a standard bucket to the working arms of a front-end loader. The specific details of the design vary with different loader manufacturers and, therefore, also need to be varied for the purpose of this invention, which can be practiced with any of the several loading machines currently available on the market, simply by replacing the plate 42 with the appropriate model corresponding to the available loading machine. With respect to the embodiment shown in the figures, the plate 42 corresponds to the coupling mechanism of the loader manufactured and sold by the Clark Equipment Company of Fargo, N.D., under the trademark Bobcat. It consists of a vertical plate with a closed upper lip 44 (forming an acute angle with the plate), an open lower lip 46 (forming an obtuse angle), and side rails 49, which together provide an easily accessible slot for a corresponding conforming plate mounted on the working arms of the Bobcat. By sliding the upper edge of the loader's plate between the rails 49, into the upper lip 44 and against plate 42, the bottom edge of the loader's plate becomes similarly engaged with the lower lip 46 and the weight of the crane assembly ensures that the two plates remain firmly connected. Of course, the connection can be further secured by safety latches or similar coupling devices (not shown in the figures) as would be obvious to those skilled in the art.

A panel 50 of hydraulic control valves is mounted on a frame 52 comprising two arms 54 pivotally hinged to the upper rear beam 16 by means of brackets 56 and bolts 58 that allow the frame to be raised or lowered for placement within reach of an operator sitting in the seat of the loader to which the invention is attached. Depending on the specific loader used, the position of the frame 52 can be adjusted up or down to ensure that the operator has a clear view of the work in progress and comfortable use of the control levers 62. Each lever is connected to a hydraulic valve that actuates a corresponding hydraulic cylinder, as detailed below, to perform a specific function for the operation of the crane attachment. The inlet of each valve is connected to a common source receiving hydraulic pressure from a pair of lines coupled to the hydraulic system of the loader through a standard hydraulic quick-coupler (not shown in the drawings), usually found on auxiliary lines in all machines using hydraulic power. The outlet of each valve is connected through a separate line (shown in the figures collectively as 60) to a corresponding cylinder, so as to control its expansion and contraction by regulating the hydraulic fluid flow through the valve, according to principles and technology well understood by those skilled in the art. Accordingly, the details of the hydraulic system of the invention are not described here beyond what is necessary to explain the working of each functional component.

Two outriggers 64 are mounted on the sides of the support frame 10 at approximately 45 degree angle with the side beams 12. Each outrigger consists of a leg 66, hinged to a corresponding side beam 12 and reinforcing brace 32 by means of a standard bracket 68, and of a hydraulic cylinder 70, similarly hinged to the side beam 12 and to a lever arm 72 at the tip of the leg 66. The expansion of the hydraulic cylinder 70 causes the outrigger to be lowered and extend in an out and forward direction until the pads 74 are firmly planted on the ground, resulting in a wider base than that provided by the wheels 34 for greater stability of operation. The contraction of the cylinder, on the other hand, causes the leg to be raised to an almost vertical position of rest, useful for transportation and storage of the crane attachment. As typically found in all outrigger assemblies, the pads 74 are also pivotally hinged to the tips of the legs, so that they are able to maintain a horizontal position at all times. FIGS. 1-3 illustrate the outriggers approximately half way between their positions of operation and rest, as they would not normally stand, in order to facilitate their description in the drawings.

Finally, the sleeve 18 consists of a hollow cylindrical housing (such as a pipe), a collar plate 78 and an end plate 76, holding in place two bearings 80 and 82. Bearing 80 consists of a standard axle bearing for receiving and providing lateral support to the bottom end of the boom platform's axle, as detailed below. The end plate 76, which can be welded or bolted to the bottom of the sleeve, is used as a retainer and protective cover for bearing 80. Bearing 82, on the other hand, is conical and provides not only lateral but also vertical support to the top end of the boom platform's axle. This bearing is fitted within the inner rim of the collar 78 at the top of the sleeve.

Figure 4:
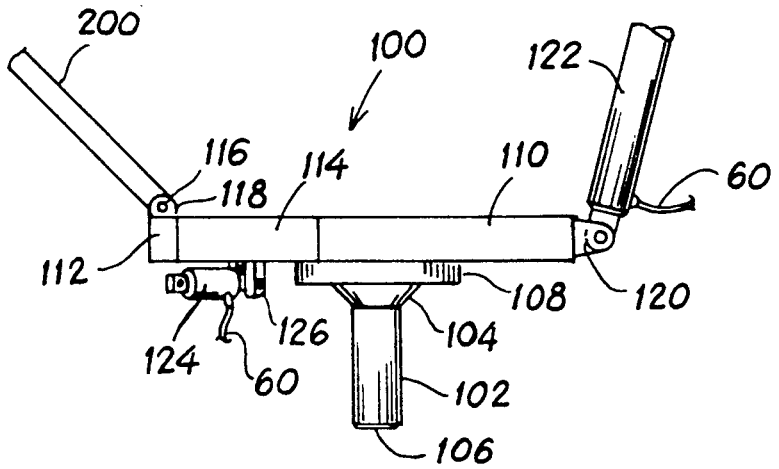
FIG. 4 illustrates an elevational side view of the boom platform of the invention, also shown in isolation for clarity of description.
Figure 5:
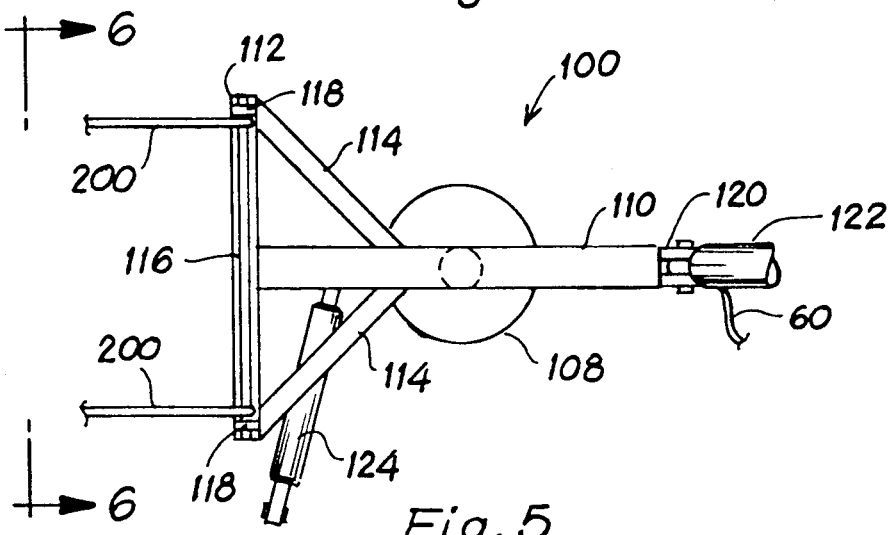
FIG. 5 illustrates a plan view of the boom platform shown in FIG. 4.
Figure 6:
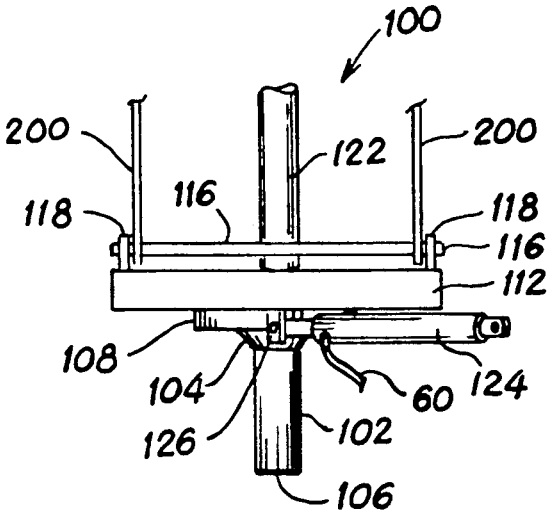
FIG. 6 illustrates a rear view of the same boom platform taken along line 6—6 in FIG. 5.

Referring now to FIGS. 4-6, various views of the boom platform 100 used in conjunction with the support frame 10 are shown in isolation. A vertical axle 102, rigidly connected to the structure constituting the platform by means of a support plate 108, is provided for rotatable engagement with the sleeve 18. The axle 102 is sized to fit tightly inside the inner diameter of bearings 80 and 82, within the tolerances allowable for high load operation. The upper portion 104 of the axle features a conical shape to match the inside surface of bearing 82, so that the entire weight of the platform is supported by it. Of course, the length of the axle must be such that its bottom portion 106 is fully inserted through bearing 80 without interfering with the bottom plate 76 even under maximum load. Thus, simply by gravity, the cooperative engagement of the axle 102 with the sleeve 18 provides a sturdy structure that allows the rotation of the crane assembly on the support frame.

A large beam 110 is attached diametrically to the top of the support plate 108, either by bolts, welds, or similar fastening methods. A transverse truss 112 and lateral braces 114 form a triangular platform on the rear end of the beam 110, which provides an anchor for the bottom of the crane's boom (not seen in FIGS. 4-6), which is connected to a base 200 (shown only in part in FIGS. 4-6) hinged to brackets 118 on top of truss 112 through a single pin 116. The front end of beam 110 is equipped with brackets 120 for connection with one end of a hydraulic cylinder 122 which at the other end is hinged to the upper portion of the boom, as explained below. As a result, the expansion of the cylinder 122 causes the boom to rise toward a vertical position, while its contraction allows it to tilt downward toward a horizontal position. Thus, by distributing the weight of the boom structure (and therefore also of any load lifted by it) both in front and behind the axis of axle 102, the lateral stresses on the axle are reduced and the crane attachment acquires a degree of stability that makes it possible to safely rotate the boom platform approximately 45 degrees on either side of its forward position. The end of another hydraulic cylinder 124, whose other end is also shown in part in FIG. 2 hinged to the inside of side beam 12 of the supporting frame 10, is hinged to the underside of beam 110 and provides the power to cause such rotation. Of course, the exact degree of rotation is determined by the position of the brackets 126 (attached to beam 110) and 128 (attached to side beam 12) and by the freedom of each cylinder end to self-adjust within them to the changing orientation of the cylinder as the boom platform rotates with respect to the supporting frame.

Figure 7:
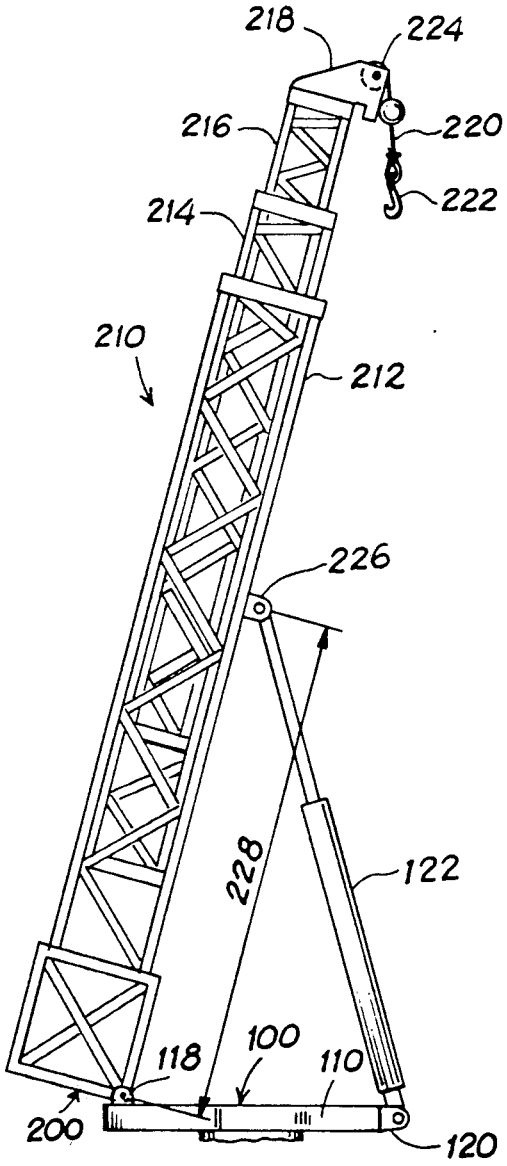
FIG. 7 illustrates an elevational side view of a three-stage boom of lattice construction mounted on the platform of FIGS. 4–6.

FIG. 7 shows a three-stage boom 210 of lattice construction (shown as made with angle iron for illustration) attached to the base 200 pivotally anchored to the support platform 100. In the embodiment illustrated in the figure, the base 200 defines an approximately cubical space for housing two hydraulic motors and cable reels for operating the boom 210 and hoist, as detailed below, but any structure suitable to support a boom pivotally anchored to the platform would be acceptable to practice the invention. Motors, cable reels, hydraulic lines and other hardware can be mounted anywhere on the structure without affecting the functioning of the boom. The boom 210 consists of at least one stage of lattice structure 212 of square cross-section extending from the base approximately twice the length of the supporting frame 10. In the preferred embodiment of the invention, three stages 212, 214 and 216 of approximately equal length and progressively decreasing cross-sections are combined in telescopic configuration, so that the boom can be extended for greater reach. Each inner stage is mounted either on rollers or low-friction pads on the inside of a corresponding outer stage, in ways well understood by those skilled in the art, so that the telescopic action of the assembly can occur smoothly when the boom is under load. The boom is extended by a hydraulically driven motor that pulls a cable strung between pairs of pulleys at the top and bottom of each stage. In the three-stage boom shown in FIG. 7, for example, the cable runs in the space between the outer and middle stages (212 and 214, respectively) from the base 200 to the top of the boom, where it loops around a pulley (not shown) attached to the outer stage 212 and returns to the bottom of the boom. There it loops around another pulley (not shown), attached to the bottom of the middle stage 214, and it runs up again in the space between the middle and the inner stages (214 and 216, respectively). At the top it loops around a third pulley (not shown) attached to the middle stage 214 and it returns to the bottom of the boom, where it is fastened to the bottom of the inner stage 216. Thus, when the cable is pulled by winding it on a reel, the inner stage 216 is first caused to be extracted by the shortening of the cable rolling around each pulley and pulling up that stage's bottom. When the inner stage 216 is fully extracted, as determined by a stop along its travel, the cable starts pulling on the bottom of the middle stage 214, causing its telescopic extraction as well until a stop along its travel is also encountered. At that point, the boom is fully extended and the cable has no travel left; therefore, its tension maintains the boom in its extended position. If the boom cable tension is released, the weight of the various stages causes them to collapse into their retracted position in the opposite sequence. Since both the extension and contraction of the various stages in the boom are controlled by gravity, it is obvious that the extension occurs in the order that results in progressively heavier stages being lifted; that is, the inner stage 216 is first extracted, followed by the middle stage 214 (which also requires the lifting of the inner stage connected to it). Of course, the reverse is true during the telescopic contraction of the boom.

The top end of the inner stage 216 is equipped with a conventional crane pulley assembly 218 and a hoist cable 220 with a hook 222 for securing and lifting objects. The cable 220 is looped around a pulley 224 and runs along the boom to a hydraulic winch (not shown in the drawings) housed in the base 200. The tension on the cable 220 determines the lifting action of the hook 222, as permitted by the stability of the entire structure. As one can appreciate from FIG. 7, the stability of the crane decreases with the greater extension of the boom because of the resulting greater leverage exerted by the load on the supporting axle 102, which is the approximate fulcrum for the assembly. Similarly, the stability of the crane is affected by the position of the boom in relation to the ground. When the cylinder 122 is totally expanded, the boom assumes a virtually vertical position, which results in maximum stability. The opposite occurs, of course, when the cylinder is totally contracted and the boom is lowered to a nearly horizontal position.

Note that the motion of the boom 210 is determined not only by the characteristics of the hydraulic cylinder 122, but also by the location of the hinge bracket 226. In fact, the distance 228 between brackets 226 and 118 on the boom, the length of the platform 110 and the length of the cylinder 122 form three sides of a triangle that at all times determines the position of the boom. As the cylinder contracts, the boom is progressively lowered to the point where it nearly assumes a horizontal position when the cylinder's plus the platform's lengths approach the length of the distance 228. Similarly, as the cylinder expands, the boom is progressively raised to the point where it assumes a nearly vertical position when the cylinder's length approaches the length of the distance 228. Therefore, for maximum versatility the cylinder dimensions must be selected so that in its contracted state the sum of its length and of the length of the platform approximates the distance 228 between the two brackets 118 and 226; and so that in its extended state its length alone approximates the distance 228. Of course, for a given boom length, the hydraulic power of the cylinder 122 required to operate the assembly increases as the distance 228 decreases because of the resulting lengthened lever arm acting on the hinge in bracket 226. For efficient performance it is found that bracket 226 should be located at least half way up the length of the boom.

Figure 8:
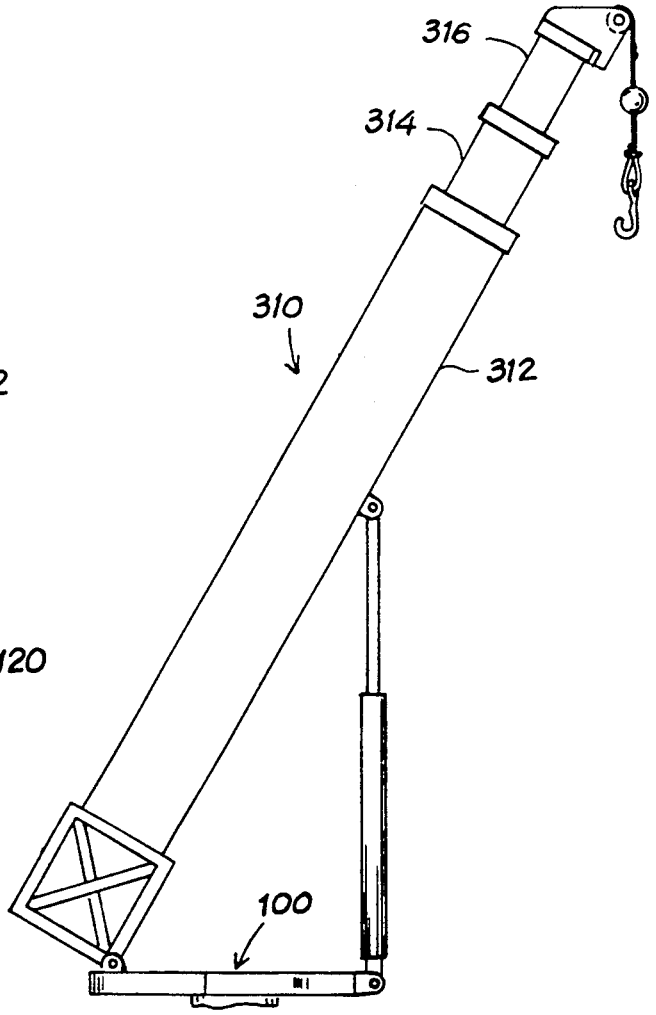
FIG. 8 illustrates an elevational side view of an alternative boom embodiment consisting of a three-stage boom of tubular construction mounted on the platform of FIGS. 4–6.

FIG. 8 illustrates another embodiment of a boom 310 for the invention, wherein three cylindrical stages 312, 314 and 316 of decreasing diameter are slideably connected in telescopic engagement to provide the extension action described above. Suitable low-friction pads or rollers can be used here as well in the annular space between each pair of cylinders in order to provide the required support for smooth operation. Of course, tubing of any cross-section, such as square or triangular, would provide the same function. Similarly, either the same boom cable system described above can be used to control the boom's extension and contraction, or any equivalent method known in the art. In fact, it is clear that any conventional boom could be used with a hydraulic cylinder in the described configuration to practice this invention.

Figure 9:
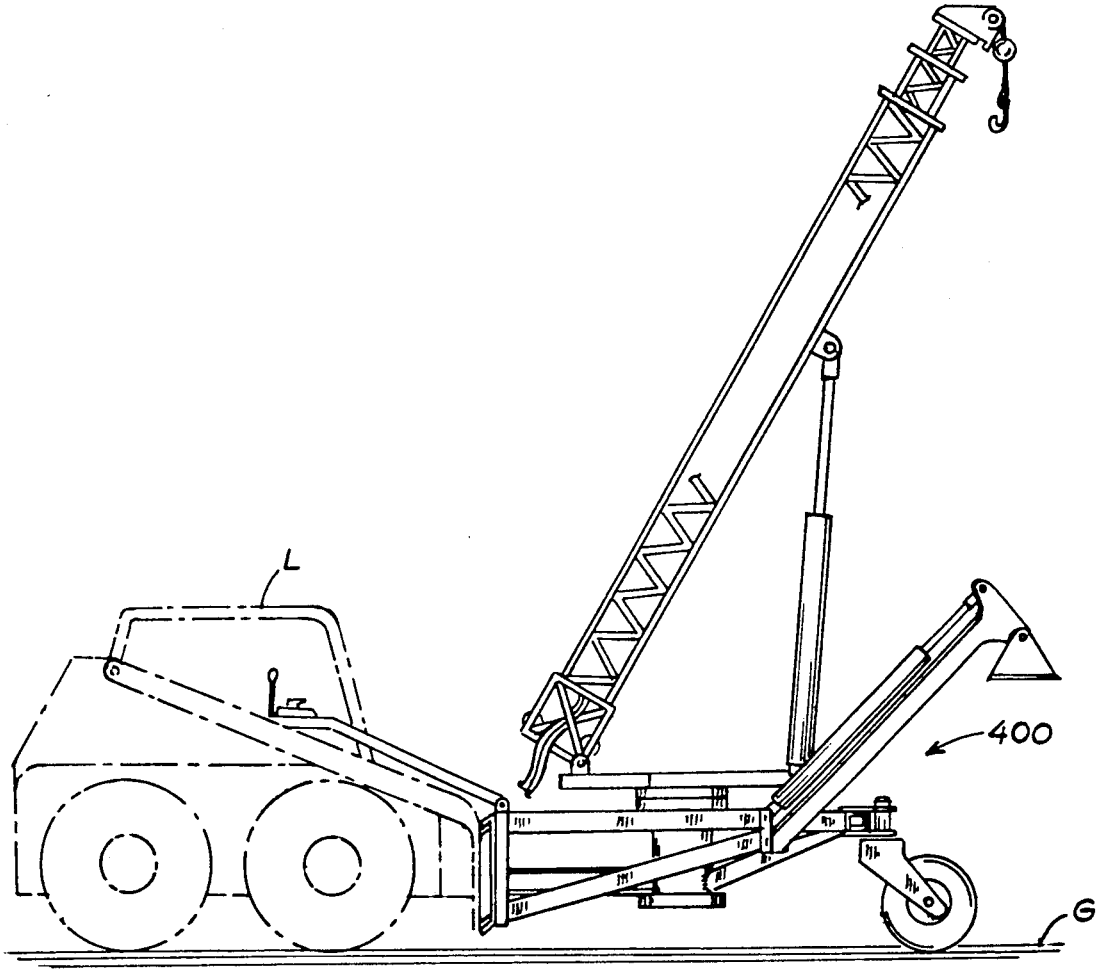
FIG. 9 shows the crane attachment of this invention resulting from the combination of the components described in FIGS. 1-7.

FIG. 9 shows the crane attachment 400 resulting from the combination of the components described in FIGS. 1-7 after coupling with a conventional loading machine L. The details of the hydraulic system are not illustrated because conventional hardware and techniques, well known to those skilled in the art, are used in the implementation of the working arrangement herein described. Similarly, safety latches and adjustment gears for the coupling mechanism, the outriggers and the control valve frame are not shown for simplicity of illustration. They all constitute components that are well understood in the art and that can be easily substituted with equivalent hardware used for the same functions in construction equipment.

In operation, the crane attachment of this invention is connected to a loading machine by coupling the plate 42 with a conforming plate on the working arms of the loader itself, as explained above. Because of the quick-release action of the coupling mechanisms of these machines, such as in skid steer loaders, the task of connecting (and disconnecting) the crane attachment to a loader, including the hydraulic hook-up with the loader's auxiliary lines, can be performed in a few minutes. The control valve frame is then lowered toward the loader's operator seat to rest on a structural crosspiece on the loader itself. Thus, upon connection, the crane attachment is fully powered through the loader's hydraulic system and controllable from the loader's operator's seat. Since the crane attachment is now supported by the loader and by its own wheels, it can be moved around as an accessory of the loader. So long as the outrigger pads are not on the ground, the crane can be moved even while loaded, thus providing additional flexibility to its utilization. The weight of the loader itself provides additional ballast to increase the stability and load capacity of the crane.

For maximum lift and stability, the outriggers are lowered and their pads firmly planted on the ground as close as possible to the work site before an object is fastened to the hook and lifted. Because of the telescopic action of the boom, its vertical maneuverability and the rotational capability of the supporting platform, it is possible not only to lift an object but also to place it within a relatively wide range of reach without moving the loader. Moreover, if necessary, the outrigger pads may be lifted sufficiently to clear the ground, thus allowing the loader to travel freely with the loaded crane attachment coupled to it. This type of maneuver should obviously be avoided unless necessary because of the reduced stability resulting from the smaller base (the outriggers being disengaged) and from dynamic forces (the loader being in motion), but this added working flexibility gives the attachment of this invention an exceptional utility advantage over the prior art. In fact, because of the ability to lower the boom to a virtually horizontal stance, this crane attachment can be used to pick up a load over an obstacle (like a standard crane can do) and then to carry it through low ceilings and maneuver it in a closed environment (like a conventional loader) simply by properly utilizing its various handling functions.

It is noted that the loader operator controls all of the crane functions from the control panel 50 mounted on frame 52. In the embodiments described herein, six valves control the motion of four hydraulic cylinders (a cylinder 70 for each of the two outriggers, 124 for the platform's rotation, and 112 for the boom's elevation) and two hydraulic motors for the boom cable (telescopic action) and the hoist cable (winch action). Nevertheless, the hydraulic motors could easily be replaced by electric motors 211 powered by the loader's electrical system, so long as sufficient power could be delivered at each motor's output shaft. It is believed that a 5-ton motor is desirable for the crane attachment described above, which features a three-stage boom approximately 12 feet long (in its contracted state), a set of wheels about five feet apart, and a five foot long support frame. It is also recommended that all hydraulic cylinders be of the double action type in order to ensure control in both directions of use. Using a working pressure of 2,100 psi, which is normal for construction equipment, the above described embodiment demonstrated a maximum lifting capacity of about 10,000 pounds with its boom in a vertical position, and a 2,000 pound capacity with its boom fully extended (about 30 feet long) at approximately 45 degrees forward.

Finally, because of the ability to lower the boom to an almost horizontal position and to move the loader about as with any standard attachment, the crane attachment of this invention can be transported with the loader itself on a regular trailer. So long as the length of the trailer allows the placement of the caster wheels in a secure position in front of the loader, the boom can be lowered over the cabin of the vehicle pulling the trailer and the entire assembly can be safely transported in the same manner and with the same precautions required for transporting the loader alone.

It is anticipated that the general structure described herein would be implemented in a variety of ways depending on the overall size and use characteristics for which the crane attachment is intended. For example, any material suitable for the construction of the boom lattice could be used instead of angle iron, such as strap or tubing. In addition, an electronic control, using either a hard-wired pigtail connection or a wireless remote panel, could replace the hydraulic valve panel described in the specification of the invention. These remote panels are available through several manufacturers and can be adapted to meet the specific requirements of the crane attachment and the loader for which it is intended. Similarly, a hydraulic cylinder, or a combination of cylinders, could be used for the telescopic action of the boom instead of the hydraulically driven cable system described above. Finally, it is anticipated that adjustable drop legs may be added to the support frame to provide support for the crane when it is detached from a loading machine, thus eliminating the need to utilize miscellaneous material, such as the block shown in the figures, to keep the crane in a horizontal position while at rest.

Various other changes in the details, steps and materials that have been described may be made by those skilled in the art within the principles and scope of the invention herein illustrated and defined in the appended claims. Therefore, while the present invention has been shown and described herein in what is believed to be the most practical and preferred embodiments, it is recognized that departures can be made therefrom within the scope of the invention, which is therefore not to be limited to the details disclosed herein but is to be accorded the full scope of the claims so as to embrace any and all equivalent apparatus and methods.

What I claim as my invention is:

1. A crane attachment for a loading machine having working arms for lifting and moving objects, comprising, in combination:

(a) a wheeled-mounted rigid support frame, having a quick-release coupling mechanism for attachment to a conforming mechanism on the working arms of said loading machine; having a control panel mounted on an adjustable frame capable of being placed within the reach of an operator of said loading machine; and having a centrally located vertical sleeve capable of receiving and rotatably cooperating with an axle inserted therethrough;

(b) a horizontal boom platform affixed to a centrally located vertical axle inserted in said vertical sleeve and capable of rotation therewithin;

(c) first means for causing the rotation of said axle and said boom platform affixed thereto within said vertical sleeve;

(d) a boom hinged behind said vertical axle on the rear portion of said boom platform;

(e) second means for controlling the angle of said boom;

(f) third means for lifting objects from the top end of said boom; and (g) fourth means for actuating said first, second and third means.

2. The crane attachment defined in claim 1, wherein said first means for causing the rotation of said axle and said boom platform affixed thereto within said vertical sleeve consists of a double-action hydraulic cylinder connected between said support frame and said boom platform.

3. The crane attachment defined in claim 1, wherein said second means for controlling the angle of said boom consists of a hydraulic cylinder hinged in front of said vertical axle on the front portion of said boom platform and connected to said boom.

4. The crane attachment defined in claim 1, wherein said third means for lifting objects from the top end of said boom consists of a retractable cable and hook extending from a pulley at the tip of said boom.

5. The crane attachment defined in claim 1, wherein said fourth means for actuating said first, second and third means consists of a hydraulic system connected to the hydraulic circuit of said loading machine.

6. The crane attachment defined in claim 1, wherein said fourth means for actuating said first, second and third means consists of a hydraulic system, connected to the hydraulic circuit of said loading machine, for said first and second means; and of an electrical system, connected to the electrical circuit of said loading machine, for said third means.

7. The crane attachment defined in claim 1, wherein said wheel-mounted rigid support frame is equipped with two wheels mounted on the front portion of said support frame.

8. The crane attachment defined in claim 7, wherein said two wheels are mounted on casters.

9. The crane attachment defined in claim 1, wherein said quick-release coupling mechanism for attachment to a conforming mechanism on the working arms of said loading machine consists of a vertical plate with a closed upper lip, an open lower lip, and two side rails, which together provide an easily accessible slot for a corresponding conforming plate mounted on the working arms of said loading machine.

10. The crane attachment defined in claim 9, wherein said vertical plate is detachable.

11. The crane attachment defined in claim 1, wherein said adjustable frame capable of being placed within the reach of an operator of said loading machine comprises two arms pivotally hinged to the upper rear portion of said support frame so that said frame can be raised or lowered for ensuring that said operator has a clear view of the work in progress and comfortable use of said control panel.

12. The crane attachment defined in claim 1, wherein said boom comprises multiple telescopically connected stages for varying the reach of said crane attachment.

13. The crane attachment defined in claim 12, wherein said boom is of lattice construction.

14. The crane attachment defined in claim 12, wherein said boom is of tubular construction.

15. The crane attachment defined in claim 1, further comprising two outriggers that extend forward and enlarge the supporting base of said crane attachment.

16. The crane attachment defined in claim 15, wherein each of said two outriggers is mounted on one side of said support frame at approximately 45 degree angle from the front and consists of a leg, hinged to said support frame, of a hydraulic cylinder, positioned above said leg and similarly hinged to said support frame and said leg, and of a pad, pivotally attached to the tip of said leg.

* * * * *